US008864442B2

(12) United States Patent
Tomaso

(10) Patent No.: US 8,864,442 B2
(45) Date of Patent: Oct. 21, 2014

(54) MIDSPAN PACKING PRESSURE TURBINE DIAGNOSTIC METHOD

(75) Inventor: Christopher M. Tomaso, Albany, NY (US)

(73) Assignee: General Electric Company, Schenectady, NY (US)

( * ) Notice: Subject to any disclaimer, the term of this patent is extended or adjusted under 35 U.S.C. 154(b) by 956 days.

(21) Appl. No.: 12/957,647

(22) Filed: Dec. 1, 2010

(65) Prior Publication Data

US 2012/0137686 A1 Jun. 7, 2012

(51) Int. Cl.
*F01D 11/00* (2006.01)
*F01D 17/08* (2006.01)

(52) U.S. Cl.
CPC ..... *F01D 17/08* (2013.01); *F05D 2260/80* (2013.01)
USPC ..... 415/112; 416/61

(58) Field of Classification Search
USPC ..... 415/118, 112, 115; 416/61
See application file for complete search history.

(56) References Cited

U.S. PATENT DOCUMENTS

2009/0238679 A1 9/2009 Hernandez et al.

*Primary Examiner* — Dwayne J White
(74) *Attorney, Agent, or Firm* — Nixon & Vanderhye P.C.

(57) ABSTRACT

An opposed-flow steam turbine having an HP section and an IP section connected by a shaft, with mid-span packing surrounding the shaft in a region between the HP and IP sections; and a steam conduit extending from the mid-span packing and through a shell of the turbine; the steam conduit incorporating a pressure tap for directly and continuously measuring pressure in the mid-span packing during operation of the steam turbine.

9 Claims, 2 Drawing Sheets

MIDSPAN PACKING PRESSURE TURBINE DIAGNOSTIC METHOD

BACKGROUND OF THE INVENTION

This invention relates to a diagnostic tool used to determine degradation of turbine components by pressure measurements in the mid-span packing region between HP and IP sections of the turbine.

Often when conducting a performance validation test on a steam turbine, the flow between the High Pressure (HP) and Intermediate Pressure (IP) sections through the mid-span packing is unknown because it cannot be measured directly. The methods used to determine this flow are very time consuming, require significant cooperation from the customer and their unit operators, and are only completed on units with precision contractual tests, or units that are the subject of characterization tests. Because of these constraints, an assumed value of this flow is used in the majority of performance analyses.

Some units have a provision for performing a blowdown test. To carry out the test, a port is provided through the packing head and shell, with an attached pipe containing an isolation valve and a test section for attaching instrumentation used for measuring temperature, pressure and flow. During normal operation when no test is undertaken, however, the isolation valve is closed, and the test instrumentation is removed.

There remains a need, therefore, for a simple and relatively inexpensive technique for continuously measuring pressure at the mid-span packing region between the HP and IP sections of a steam turbine, so that the gathered pressure can be used as an ongoing diagnostic tool for determining/identifying degradation of various turbine components.

BRIEF SUMMARY OF THE INVENTION

In a first exemplary but nonlimiting embodiment, the invention relates to an opposed-flow steam turbine having an HP section and an IP section connected by a shaft, with mid-span packing surrounding the shaft in a region between the HP section and the IP section; and a steam conduit extending from the mid-span packing and through a shell of the turbine; the steam conduit incorporating a pressure tap for directly and continuously measuring pressure in the mid-span packing during operation of the steam turbine.

In another exemplary but nonlimiting embodiment, the invention relates to an opposed-flow steam turbine having an HP section and an IP section connected by a shaft, with mid-span packing surrounding the shaft in a region between the HP section and the IP section; and wherein a steam conduit extends from the mid-span packing and through a shell of the turbine and connects to a condenser, the steam conduit incorporating an isolation valve and a blowdown orifice upstream of the condenser; and a pressure tap attached to the steam conduit for directly and continuously measuring steam pressure in the mid-span packing, the pressure tap located externally of the mid-span packing and upstream of the isolation valve.

In still another exemplary but nonlimiting embodiment, the invention relates to a method of operating an opposed-flow steam turbine having an HP section and an IP section connected by a shaft, with mid-span packing surrounding the shaft in a region between the HP section and the IP section, the method comprising providing a steam conduit extending from the mid-span packing and through a shell of the turbine; mounting a pressure tap in the steam conduit; and measuring steam pressure in the mid-span packing directly and substantially continuously during operation of the opposed flow steam turbine.

The invention will now be described in connection with the drawings identified below.

DETAILED DESCRIPTION OF THE INVENTION

Figure 1:
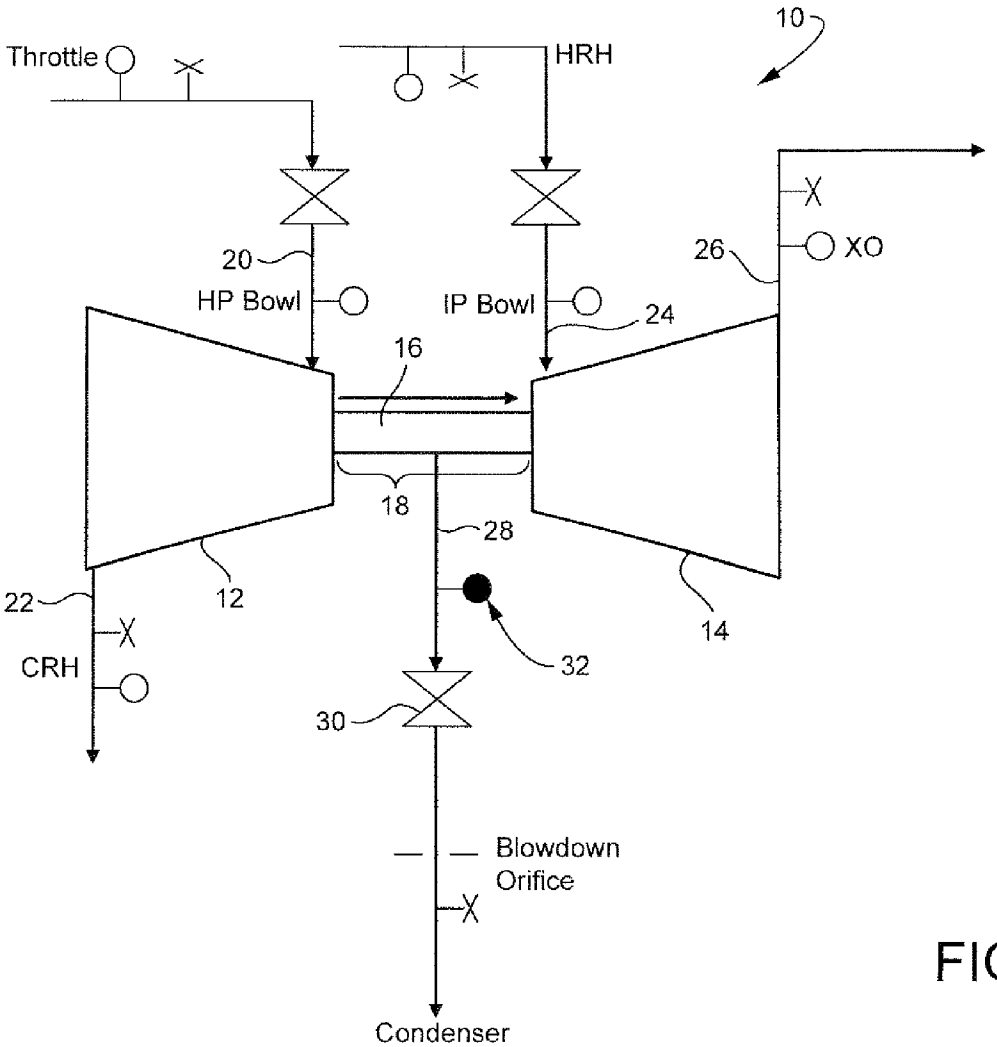
FIG. 1 is a simplified schematic diagram of opposed-flow, HP and IP sections of a steam turbine configured for blowdown testing, but modified in accordance with a first exemplary but nonlimiting embodiment of the invention.

With initial reference to FIG. 1, a steam turbine in accordance with a first exemplary but nonlimiting embodiment of the invention is generally indicated at 10. The steam turbine 10 includes a first or high pressure (HP) turbine section 12 operatively connected to an opposing second or intermediate pressure (IP) turbine section 14 by a shaft or rotor 16. Mid-span packing assembly (or simply, mid-span packing) 18 extends about the shaft 16 and may include a plurality of packing rings (not shown but conventional in nature) that prevent or minimize steam leakage about and along the shaft 16.

High pressure steam is emitted to the turbine or HP bowl 12 by means of conduit 20 while spent steam is routed to a cold reheater via line 22. High reheat steam is supplied to the IP bowl 14 via conduit 24, with spent steam exiting line 26. During operation, a portion of the high temperature/high pressure steam flows along the shaft 16 within the mid-span packing assembly 18, toward the IP section 14. Steam entering the turbine section 14 impacts the overall efficiency of the turbine 10 and thus, it is desirable to control leakage about and along the shaft 16 through the mid-span packing.

In turbine configurations as shown in FIG. 1, provision is made for a blowdown test, a hole is provided through the packing head and shell, with a pipe or conduit 28 attached, incorporating an isolation or blowdown valve 30 and blowdown orifice as shown in FIG. 1. A test section is identified downstream of the valve 30 where pressure, temperature and flow measurements are taken. During normal turbine operation, the valve 30 is closed. When a blowdown test is required, the necessary instrumentation is added in the test section and valve 30 is opened, drawing steam from both turbine sections 12 and 13 into the conduit 28. Typically after a blowdown test, the data-gathering instrumentation is removed and the blowdown valve 30 closed while normal turbine operation continues.

In accordance with an exemplary but nonlimiting embodiment of this invention, a pressure tap or sensor 32 is located in the conduit 28 upstream of the blowdown or isolation valve 30. During normal turbine operation and with the isolation or blowdown valve 30 closed, the pressure tap or sensor 32 will record the pressure within the mid-span packing 18, with any leakage steam flowing passed the mid-span packing in one direction along the rotor, from the HP turbine section 12 to the IP turbine section 14.

The direct pressure measurements, taken over sustained periods of time while the turbine is in operation, provide a reliable diagnostic tool. For example, an indication of the state of the packing within the mid-span packing 18 may be obtained in various ways. Specifically, the measured pressure at the time of the test can be compared to the design pressure to guide an assumption about the amount of N2 flow; the measured pressure during an N2 inference test can be used to ensure that the test itself is not affecting the sealing surfaces of the turbine; the measured pressure ratio between the HP section 12 and the mid-span packing 18 over time can be used to monitor changes in the seal clearances in the packing 18; or a constant measured pressure during a time period with a change in IP section efficiency could indicate internal damage, that may be opening other leakage flow paths between the HP and IP sections.

Thus, the present arrangement can help diagnose performance shortfalls on new units as well as indicate degradation on in-service units. Validation teams can use these pressure readings to conduct more accurate analyses; design teams can use the data to verify their assumptions; and the commercial team may use the data to remedy any performance shortfalls and to guarantee as well as to identify any areas in an existing unit that may be suited for an upgrade.

Figure 2:
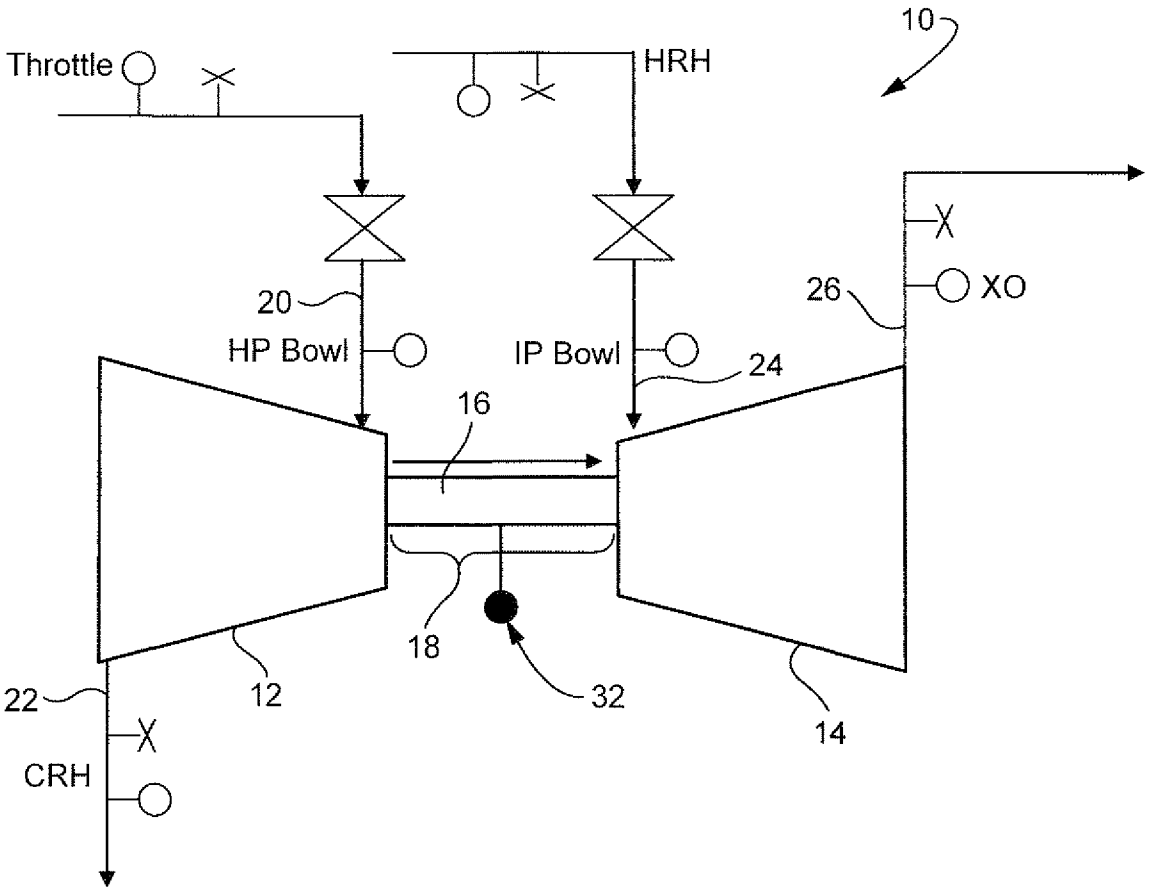
FIG. 2 is a simplified schematic diagram of opposed-flow, HP and IP sections of a steam turbine that is not configured for blowdown testing, but modified in accordance with a second exemplary but nonlimiting embodiment of the invention.

FIG. 2 illustrates a similar arrangement but where no blowdown provision has been incorporated into the turbine. Here, the pressure tap or sensor 32 can be applied directly at the mid-span packing assembly 18 to achieve the same result as provided in the arrangement as FIG. 1.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An opposed-flow steam turbine having an HP section and an IP section connected by a shaft, with mid-span packing surrounding said shaft in a region between said HP section and said IP section; and a steam conduit extending from said mid-span packing and through a shell of the turbine;

said steam conduit incorporating a pressure tap for directly and continuously measuring pressure in said mid-span packing during operation of the steam turbine;

wherein said steam conduit connects to a condenser and incorporates an isolation valve downstream of said pressure tap and upstream of said condenser; and further wherein a blowdown orifice is located between said isolation valve and said condenser.

2. An opposed-flow steam turbine having an HP section and an IP section connected by a shaft, with mid-span packing surrounding said shaft in a region between said HP section and said IP section; and wherein a steam conduit extends from said mid-span packing and through a shell of the turbine and connects to a condenser, said steam conduit incorporating an isolation valve and a blowdown orifice upstream of said condenser; and a pressure tap attached to said steam conduit for directly and continuously measuring steam pressure in said mid-span packing, said pressure tap located externally of said mid-span packing and upstream of said isolation valve.

3. A method of operating an opposed-flow steam turbine having an HP section and an IP section connected by a shaft, with mid-span packing surrounding the shaft in a region between the HP and IP sections, the method comprising:

a. providing a steam conduit extending from the mid-span packing and through a shell of the turbine;

b. closing a valve to block steam flow through the steam conduit, wherein a pressure tap is in the steam conduit upstream of the valve; and c. measuring steam pressure in the mid-span packing substantially continuously during operation of the opposed flow steam turbine and while the steam conduit is closed by using the pressure tap to monitor steam pressure in the steam conduit.

4. The method of claim 3 further comprising:

d. using measured steam pressure data obtained from said pressure tap as a diagnostic tool for identifying performance shortfalls on new turbines or degradation on in-service turbines.

5. The method of claim 4 wherein performance shortfalls on new turbines or degradation on in-service turbines include out-of-specification packing clearance.

6. The method of claim 4 wherein performance shortfalls on new turbines or degradation on in-service turbines include leakage from the HP to the IP section from one or more seals other than said mid-span packing.

7. The method of claim 4 wherein step d. includes comparing measured steam pressure data to design pressure to guide an assumption of an amount of N2 flowing in the mid-span packing.

8. The method of claim 4 wherein step d. includes using measured steam pressure data obtained from the pressure tap as a diagnostic tool for monitoring changes in packing clearance over time.

9. A method of operating an opposed-flow steam turbine having a high pressure turbine section and lower pressure turbine section connected by a shaft, with mid-span packing surrounding the shaft between the turbine sections, the method comprising continuously monitoring steam pressure in the mid-span packing using a pressure tap mounted to a conduit open to the mid-span packing, wherein the conduit is closed and blocks steam flow through the conduit during the monitoring of the steam pressure.

* * * * *